US008360256B2

(12) United States Patent
O'Brien

(10) Patent No.: US 8,360,256 B2
(45) Date of Patent: Jan. 29, 2013

(54) STORAGE AND DRINKING CONTAINER HAVING CAP AND RETAINING RING

(75) Inventor: Michael O'Brien, London (GB)

(73) Assignee: Packaging Innovation Limited, London (GB)

( * ) Notice: Subject to any disclaimer, the term of this patent is extended or adjusted under 35 U.S.C. 154(b) by 736 days.

(21) Appl. No.: 12/226,402

(22) PCT Filed: Mar. 23, 2007

(86) PCT No.: PCT/GB2007/050146

§ 371 (c)(1),
(2), (4) Date: Dec. 10, 2008

(87) PCT Pub. No.: WO2007/119075

PCT Pub. Date: Oct. 25, 2007

(65) Prior Publication Data

US 2009/0101620 A1 Apr. 23, 2009

(30) Foreign Application Priority Data

Apr. 18, 2006 (GB) ..... 0607552.7

(51) Int. Cl.
*B65D 45/32* (2006.01)

(52) U.S. Cl. ..... 215/274; 215/225; 215/252; 215/272; 215/275; 215/310; 215/314; 215/317; 215/318; 220/281

(58) Field of Classification Search ..... 215/225, 215/252, 270, 274–276, 310, 313, 314, 272, 215/317, 318; 220/281
See application file for complete search history.

(56) References Cited

U.S. PATENT DOCUMENTS

| | | | | |
|---|---|---|---|---|
| 1,477,902 | A | 12/1923 | Robinson | |
| 1,862,620 | A * | 6/1932 | Graham | 215/274 |
| 2,045,480 | A * | 6/1936 | Magnesen et al. | 215/250 |
| 3,415,405 | A * | 12/1968 | Ignell et al. | 215/253 |
| 3,708,083 | A | 1/1973 | Gronemeyer et al. | |

(Continued)

FOREIGN PATENT DOCUMENTS

| | | |
|---|---|---|
| BE | 707837 | 4/1968 |
| CA | 2030609 | 5/1992 |

(Continued)

OTHER PUBLICATIONS

Search Report entitled "Bottle Cap" prepared by Applicant.

(Continued)

*Primary Examiner* — J. Gregory Pickett
*Assistant Examiner* — Ned A Walker
(74) *Attorney, Agent, or Firm* — Christie, Parker & Hale, LLP

(57) ABSTRACT

A storage and drinking container for pressurized beverages includes a drinking vessel 1 having a lip 3 and a lid formed from a cap 5 and retaining ring 12. The cap 5 seals with a surface 4 on the inside neck of the vessel and is retained in place by fingers 8 engaging under a lip 3. The fingers 8 are retained in position by a retaining ring 12. Cooperating sets of cammed surfaces 10 and 13 on cap 5 and ring 12 act on rotation of the ring to axially separate the ring 12 from the cap 5, releasing the fingers 8 from under the lip 3 and permitting the lid to be removed. A drinking vessel with a wide neck can be reliably sealed without the necessity to provide screw threads on the outer surface of the vessel 1.

21 Claims, 7 Drawing Sheets

U.S. PATENT DOCUMENTS

| | | | | | |
|---|---|---|---|---|---|
| 3,825,144 | A | | 7/1974 | Wiedmer | |
| 3,871,544 | A | | 3/1975 | Peyser | |
| 3,976,216 | A | | 8/1976 | Lambert | |
| 4,042,143 | A | | 8/1977 | Biggins | |
| 4,157,764 | A | * | 6/1979 | Moller | 220/260 |
| 4,206,852 | A | * | 6/1980 | Dunn et al. | 215/252 |
| 4,518,097 | A | | 5/1985 | Milton et al. | |
| 4,640,435 | A | | 2/1987 | Dutt | |
| 4,714,167 | A | | 12/1987 | Sandhaus | |
| 4,729,487 | A | * | 3/1988 | Wright | 215/220 |
| 4,747,511 | A | | 5/1988 | Dutt et al. | |
| 4,771,905 | A | | 9/1988 | Perne et al. | |
| 4,957,211 | A | * | 9/1990 | Ekkert et al. | 215/230 |
| 5,181,615 | A | * | 1/1993 | Thompson | 220/618 |
| 5,209,362 | A | * | 5/1993 | Lutzker | 215/225 |
| 5,314,084 | A | * | 5/1994 | Folta et al. | 215/249 |
| 5,433,331 | A | * | 7/1995 | Morini | 215/271 |
| 5,615,788 | A | * | 4/1997 | Larguia | 215/274 |
| 5,826,739 | A | * | 10/1998 | Valyi | 215/253 |
| 5,875,915 | A | * | 3/1999 | Bradshaw et al. | 220/319 |
| 5,884,788 | A | * | 3/1999 | Wilde | 215/230 |
| 5,960,972 | A | * | 10/1999 | Larguia, Sr. | 215/274 |
| 6,158,604 | A | | 12/2000 | Larguia, Sr. et al. | |
| 6,554,019 | B1 | | 4/2003 | Grittmann | |
| 6,591,998 | B2 | * | 7/2003 | Haynes et al. | 215/276 |
| 6,679,395 | B1 | | 1/2004 | Pfefferkorn et al. | |
| 6,761,275 | B1 | | 7/2004 | McBride et al. | |
| 6,912,878 | B2 | * | 7/2005 | Belden, Jr. | 70/57.1 |
| 7,007,523 | B2 | * | 3/2006 | Belden, Jr. | 70/57.1 |
| 7,314,146 | B2 | * | 1/2008 | Mavin | 215/307 |
| 2008/0308519 | A1 | * | 12/2008 | Farrar et al. | 215/329 |
| 2008/0308554 | A1 | * | 12/2008 | Farrar et al. | 220/281 |

FOREIGN PATENT DOCUMENTS

| | | | |
|---|---|---|---|
| DE | 1 121 494 | | 1/1962 |
| DE | 1121494 | | 1/1962 |
| DE | 30 17 839 | A1 | 11/1982 |
| DE | 3017839 | | 11/1982 |
| DE | 34 13 936 | A1 | 10/1985 |
| DE | U90 10 198.7 | | 10/1990 |
| DE | 103 20 269 | B3 | 10/2004 |
| EP | 0 248 744 | A1 | 12/1987 |
| EP | 0 642 983 | A1 | 3/1995 |
| EP | 0 761 557 | A2 | 3/1997 |
| EP | 1 182 147 | A2 | 2/2002 |
| EP | 1 529 734 | A1 | 5/2005 |
| EP | 1 584 572 | A1 | 10/2005 |
| EP | 1584572 | | 10/2005 |
| FR | 2 695 914 | | 3/1994 |
| GB | 970531 | | 9/1964 |
| GB | 1 209 972 | | 10/1970 |
| GB | 2 050 320 | A | 1/1981 |
| GB | 2 322 122 | A | 8/1998 |
| JP | 39-019418 | | 9/1964 |
| JP | 48-109046 | | 8/1972 |
| JP | 50-040666 | | 7/1973 |
| JP | 52-116448 | | 3/1976 |
| JP | 56-131163 | A | 10/1981 |
| JP | 62-191649 | U | 12/1987 |
| JP | 63-12460 | A | 1/1988 |
| JP | 2-19759 | U | 2/1990 |
| JP | 9-175546 | | 7/1997 |
| JP | 10-120043 | | 5/1998 |
| JP | 2002-037306 | | 2/2002 |
| JP | 2004-224379 | | 8/2004 |
| NL | 7102784 | | 9/1972 |
| WO | WO 2004/080814 | | 9/2004 |
| WO | WO 2004/080814 | A2 | 9/2004 |
| WO | WO 2005/092728 | A1 | 10/2005 |
| WO | WO 2005/092732 | A1 | 10/2005 |
| WO | WO 2006/000779 | | 1/2006 |
| WO | WO 2006/000779 | A2 | 1/2006 |

OTHER PUBLICATIONS

UK Search Report for corresponding application No. GB0607552.7, dated Jun. 15, 2006.

International Search Report, dated Jun. 26, 2007, corresponding to PCT/GB2007/050146.

Written Opinion of the International Searching Authority, dated Jun. 26, 2007, corresponding to PCT/GB2007/050146.

* cited by examiner

STORAGE AND DRINKING CONTAINER HAVING CAP AND RETAINING RING

CROSS-REFERENCE TO RELATED APPLICATION

This application is a National Phase Patent Application and claims the priority of International Application Number PCT/GB2007/050146, filed on Mar. 23, 2007, which claims priority of British Patent Application Number 0607552.7, filed on Apr. 18, 2006.

BACKGROUND OF THE INVENTION

The present invention relates to a container for storing pressurised beverages, which container comprises a drinking vessel and a lid, wherein on removal of the lid the drinking vessel can be used to drink the contents previously stored in the container.

DESCRIPTION OF THE RELATED ART

Individual servings of pressurised beverages, for example carbonated soft drinks or beer, are normally sold in aluminium cans or bottles.

Cans for beverages normally have a ring pull which opens a small aperture in the end of the can, so that its contents can be poured or drank directly from the can. However, it would not be desirable to remove the complete top of the can because the metal from which the can is formed is necessarily very thin and so would be unpleasant to drink from and potentially dangerous.

In the case of bottles, these normally have a narrow neck and one reason for this is that it is easier to seal a small neck of a bottle, for if the surface area of the seal is small it is easier to exert a high pressure over the complete area of the seal than it would be for with a larger area seal.

One way of sealing pressurised containers with wider necks, for example jars, is to have a screw thread moulded on the outside neck of the jar, permitting an appropriately threaded cap to be screwed on and form a reliable seal with the jar, exerting pressure evenly around the sealing surface and enabling a relatively large pressure to be exerted on this surface. However, the provision of screw threads on a drinking vessel is undesirable because it has an unpleasant feel and it permits liquid to seep past the lips, causing the person drinking from the vessel to dribble.

WO 2004/080814 A2 discloses a container for carbonated beverages with a removable lid secured to a drinking vessel by a roll-crimped band, with a gasket seal provided between the lid and the drinking vessel. To open the container, pressure first has to be released by first removing a screw top on top of the container and then operating a ring pull which fractures the roll-crimp allowing the top to be removed.

SUMMARY OF THE INVENTION

It is an objective of the present invention to provide improved storage and drinking container for pressurised beverages.

According to a first aspect of the present invention there is provided a storage and drinking container for pressurised beverages, the container comprising a drinking vessel and a lid for sealing with the vessel, the lid comprising a cap and a retaining ring, wherein: the drinking vessel has an open neck for drinking from, with a circumferential inner surface of an upper portion of the neck forming a first sealing surface and a lip on a surface of the neck; the cap has a face, a peripheral wall portion and a plurality of fingers for engaging with the lip, at least a portion of the peripheral wall portion forming a second sealing surface dimensioned to fit closely to and be capable of sealing with the first sealing surface, at least one of the first or second sealing surfaces having in section opposed parallel walls in the axial direction of the neck; and the retaining ring is arranged to be retained on the cap when the lid is on the vessel, and to retain the fingers of the cap in contact with the lip.

The present invention provides a storage and drinking container for pressurised beverages with a lid that can reliably seal with the drinking vessel without the requirement of screw threads. An important feature of the invention, which enables a reliable seal to be obtained, is the provision of first and second sealing surfaces one of which has in section opposed parallel walls in the axial direction of the neck. This feature is important because it permits small amounts of movement of the lid relative to the drinking vessel without interfering with the sealing properties of the seal, for the point of sealing simply moves axially along the other sealing surface. Thus, pressure in the vessel instant on the face of the cap is transferred via the fingers of the cap to the lip of the vessel, so that pressure is acting on the lip and not on the seal. This is in contrast to normal caps placed across the top of the opening (as in a jar), where the pressure acts directly to lift the sealing face of the cap off the container, and thus any relative movement of the seal permits the pressure in the container to be released. It is for this reason that with conventional caps a relatively large pressure is required on the sealing surface, which can be achieved by having a small area of cap relative to the applied pressure, for example by crimps around a bottle cap or by screw threads on a jar, each exerting a large downward pressure on the area of the seal.

Furthermore, the present invention, by the provision a retaining ring, provides a mechanism for retaining the plurality of fingers in contact with the lip, which permits the fingers to be retained in a desired position without the application of excessive force. Thus, when the lid is placed on the vessel and before pressure builds in the container the fingers, which will normally be flexible, are simply urged to a position where they extend under the lip, requiring very little pressure to be exerted on them by the ring. Then, when pressure subsequently builds in the container, the lid can move axially away from the drinking vessel causing the fingers to transfer the pressure inside the vessel to the underside of the lip, with the retaining ring simply ensuring that the fingers are retained under the lip.

The lip may be mounted along the very top edge of the neck of the drinking vessel. Where the lip is in the form of a circumferential bead provides the top edge with a greater thickness which is more pleasing to drink from. It is also preferable that the neck and lid are circular for then the angular orientation of the lid on the drinking vessel is immaterial to the functioning of the container. However, it is envisaged that the lip could be discontinuous and made up of a number of short segments, that the container could be other than circular or that the lip could be in the form of one or more indentations formed in the neck of the container. It is preferable that the lip is on the outside of the neck but it could be on the inside of the neck above the sealing surface.

Where the lip is on an outside surface the neck, it is preferable that when the lid is on the vessel the fingers of the cap extend from the cap over the top edge of the neck, for in this way the fingers can act as a stop to limit insertion of the cap within the neck of the vessel.

Preferably, the retaining ring retains protrusions of the fingers at the end of the fingers under the lip.

Preferably, the retaining ring has a release rim arranged such that when the retaining ring is axially moved apart from the cap, the release rim engages with the fingers to lift them from under the lip. This permits the lip and the fingers to be dimensioned so that pressure inside of the vessel, acting on the fingers, acts to retain the fingers firmly under the lip, thus it does not rely on the retaining ring maintaining a pressure on the fingers. The retaining ring may also be used to release the fingers from under the lip by moving it axially apart from the cap.

It is preferable that the retaining ring and cap are arranged so that rotation of the retaining ring on the cap causes the retaining ring and cap to axially move apart. This may be implemented by one of the retaining ring or cap, or both, having one or more cam surfaces thereon, arranged such that relative rotation between the retaining ring and cap causes the cam surfaces to axially move the retaining ring apart from the cap. Thus, when the lid is securely positioned and sealed on the container, pressure within the container acting on the fingers will cause the cap to resist rotation. Thereby, a user may then remove the lid by simply rotating the retaining ring relative to the drinking vessel, which will cause the retaining ring to rotate relative to the cap and thus the retaining ring to be moved axially apart from the cap releasing the fingers and thus permitting the cap to slide out of the neck of the vessel.

Preferably, the container comprises a seal member which releases pressure from the vessel at the commencement of the rotation of the retaining ring relative to the cap, permitting pressure in the container to be released prior to the fingers being disengaged from the lip. This has two advantages, first it releases the pressure in a controlled manner from the container prior to the lid being released, and secondly it releases the pressure from the container prior to the fingers being prised out from under the lip, reducing the force required to release the fingers from under the lip.

Any number of types of pressure release members could be used but one particularly advantageous embodiment employs a frangible pin sealing a vent hole, which pin is formed integrally with the cap. The pin is positioned and the retaining ring shaped such as to ensure rotation of the retaining ring displaces the pin and releases the seal prior to further rotation causing the fingers to be released. The hole is of a predetermined size to permit the controlled release of gas and thus the pressure within the container.

It is preferable that the cap and retaining ring are pushed onto the vessel to both seal with the vessel and retain the cap on the vessel against pressure within the vessel, this providing a simple mechanism for mechanically assembling the container after the drinking vessel has been filled with a beverage.

In one preferred embodiment, the peripheral wall portion of the cap is upstanding about the circumference of the face of the cap so that the cap can be inserted into the neck of the vessel until the fingers extending from the top of the peripheral wall contact the top of the neck of the vessel, wherein the lip is on an outside surface of the neck, the retaining ring has an inner outward facing surface which abuts an inward facing surface of the wall portion and wherein the retaining ring has an outer inward facing surface which abuts an outward facing surface of the fingers to sandwich the peripheral wall portion of the cap and the fingers of the cap between the inward and outward facing surfaces of the retaining ring, with the neck and lip of the vessel sandwiched between the peripheral wall and fingers of the cap.

It is particularly advantageous if the cap has a substantially convex face towards the vessel, for such a face can be arranged so that any pressure within the vessel instant on the convex face acts to deform the face to cause the second sealing surface to exert radial pressure on the first sealing surface. This is particularly advantageous in that the greater the pressure within the vessel, the greater the radial force exerted on the sealing surface.

Advantageously, the cap and retaining ring are arranged to be fitted to the vessel by pushing the retaining ring and cap onto the vessel, wherein the face of the cap is first forced to enter the neck of the vessel until the fingers engage the top of the neck of the vessel. The retaining ring and cap are then pushed axially together causing the retaining ring to retain the fingers under the lip of the neck of the vessel. This is particularly advantageous where the cap and retaining ring are pre-assembled prior to fitting to the container, for then the single action of pushing the lid on the neck of the drinking vessel will first cause the cap to be inserted into the neck and then the retaining ring to be pushed onto the cap to retain the cap in place.

It is preferable that the cap is moulded as a single piece but the cap may comprise a single molded piece with a sealing band forming the second sealing surface, for then a softer material can be used for the second sealing surface to improve the sealing properties.

According to a second embodiment of the invention, there is provided a lid for the above referred to container

BRIEF DESCRIPTION OF THE DRAWINGS

One embodiment of the present invention will now be described, by way of example, with reference to the accompanying drawings, which like numerals are used throughout to indicate like parts and of which.

DETAILED DESCRIPTION

Figure 1:
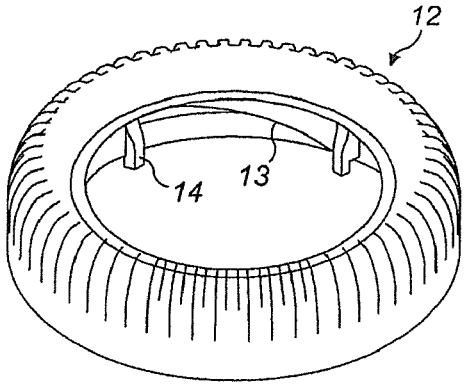
FIG. 1 is a perspective view of a retaining ring of a lid of a container in accordance with the present invention.
Figure 2:
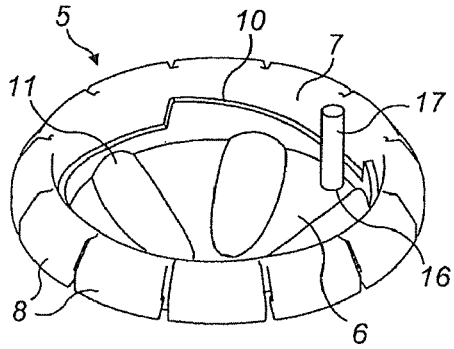
FIG. 2 is a perspective view of a cap of a lid of a container in accordance with the present invention.
Figure 3:
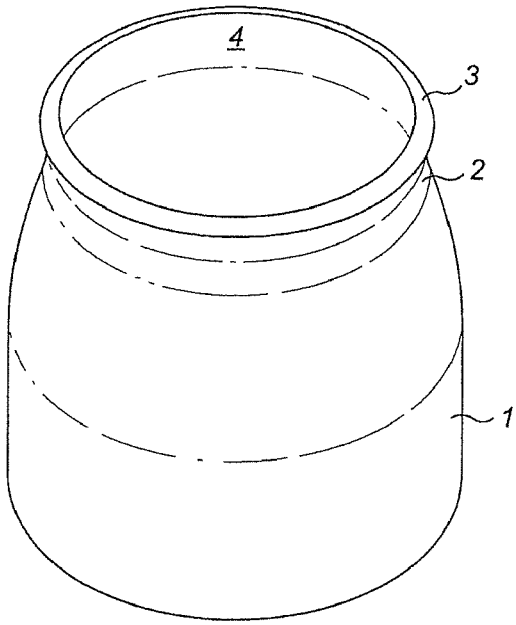
FIG. 3 is a perspective view of a drinking vessel of a container in accordance with the present invention.

Referring to FIGS. 1 to 3, a wide mouth plastic drinking container for pressurised beverages is illustrated and shown in its three component parts. FIG. 3 shows a plastic drinking vessel 1 having a open neck portion 2 with a lip 3 provided around the top edge thereof.

The inner surface of the neck 2, the opposite sides of which are in section parallel to each other, defines a first sealing surface 4.

Referring to FIG. 2, there is shown, in perspective view, a cap 5 for the drinking vessel 1 of FIG. 3. The cap is formed of a $CO_2$ resistant gas impermeable plastic such as ORGAL- LOY™ manufactured by Elf Autochem. The cap 5 is integrally molded as a single piece and comprises a convex face 6 (most clearly seen in FIG. 5), facing towards the vessel and a peripheral wall portion 7 (see FIG. 5) from the top edge of which a plurality of fingers 8 extend, each of which has a inwardly facing protrusion 9 (see FIG. 5). On the internal surface of the peripheral wall portion 7 there is molded a cap cammed surface 10. The face 6 of the cap has a plurality of radially extending reinforcing ridges 11 molded therein.

Referring now to FIG. 1, there is illustrated, in perspective view, a retaining ring 12 for the cap 5 of FIG. 2. The retaining ring 12 has a plurality of retaining ring cammed surfaces (only one of which can be seen in the FIG. 13 which cooperates with the cap cammed surfaces 10. The retaining ring 12 also has a number of protrusions 14 extending from a inner surface thereof.

Figure 4:
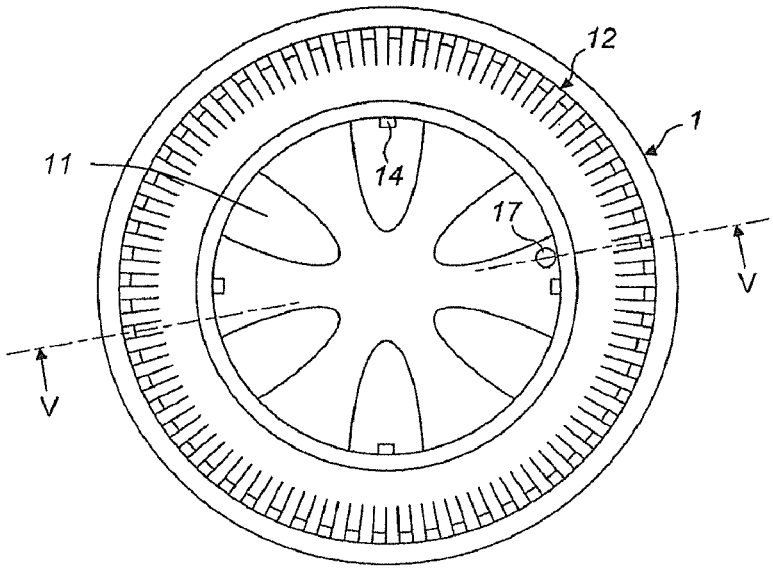
FIG. 4 is a top plan view of the container illustrated in FIGS. 1 to 3 with the retaining ring of FIG. 1 assembled on the cap of FIG. 2.
Figure 5:
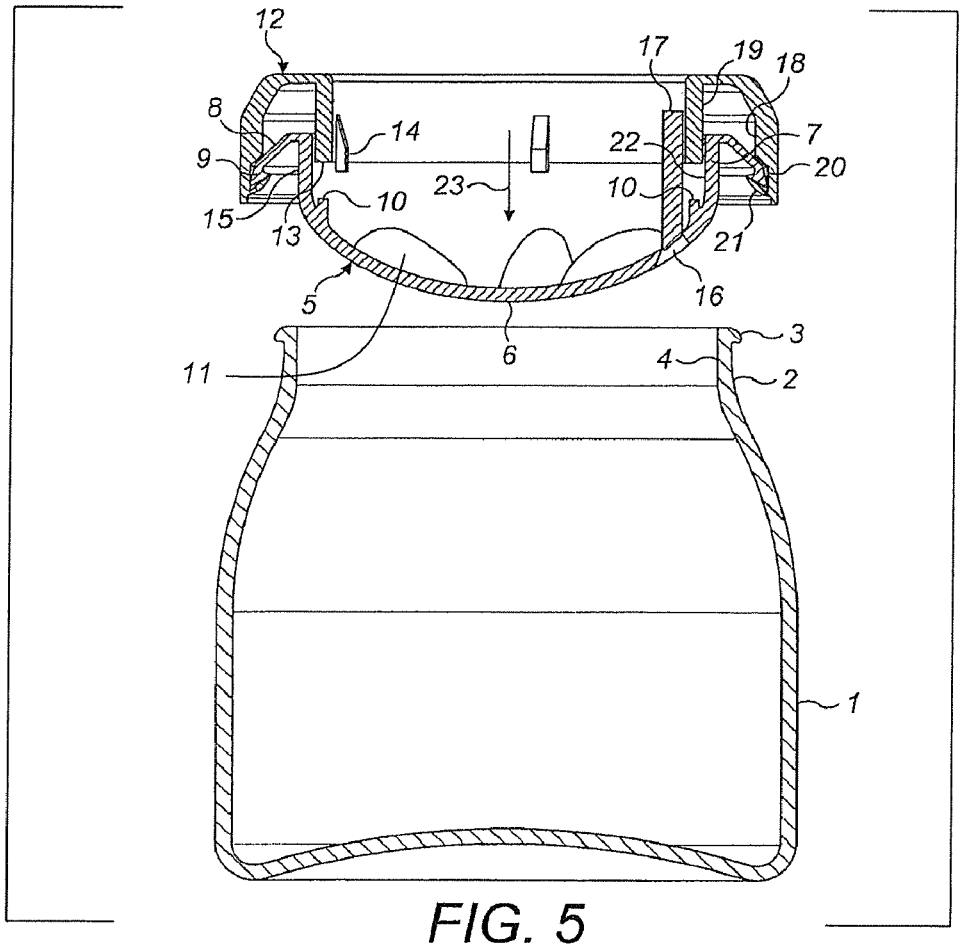
FIG. 5 is a cross-section along the line V-V of FIG. 4.

Additional features of the container are apparent from FIGS. 4 and 5, FIG. 4 is a plan view of the container shown in cross-section in FIG. 5. From FIG. 5, the peripheral wall portion 7 of the cap 5 is seen to have in section vertical opposed outer surfaces defining a second sealing surface 15 for sealing with the first sealing surface 4 of the drinking vessel 1. The second sealing surface 15 is shown as being formed from the integrally molded single material of the cap 5. However, it may alternatively comprise of a layer of soft material, such as rubber, provided on the outer surface of the peripheral wall portion 7 to assist in sealing with the sealing surfaces 4 of the drinking vessel.

As also seen from FIGS. 4 and 5, the cap 5 further includes a small hole 16 of a predetermined size sealed by a frangible pin 17, which is integrally molded with the cap 5. The purpose of this is described below with reference to subsequent figures.

Figure 9:
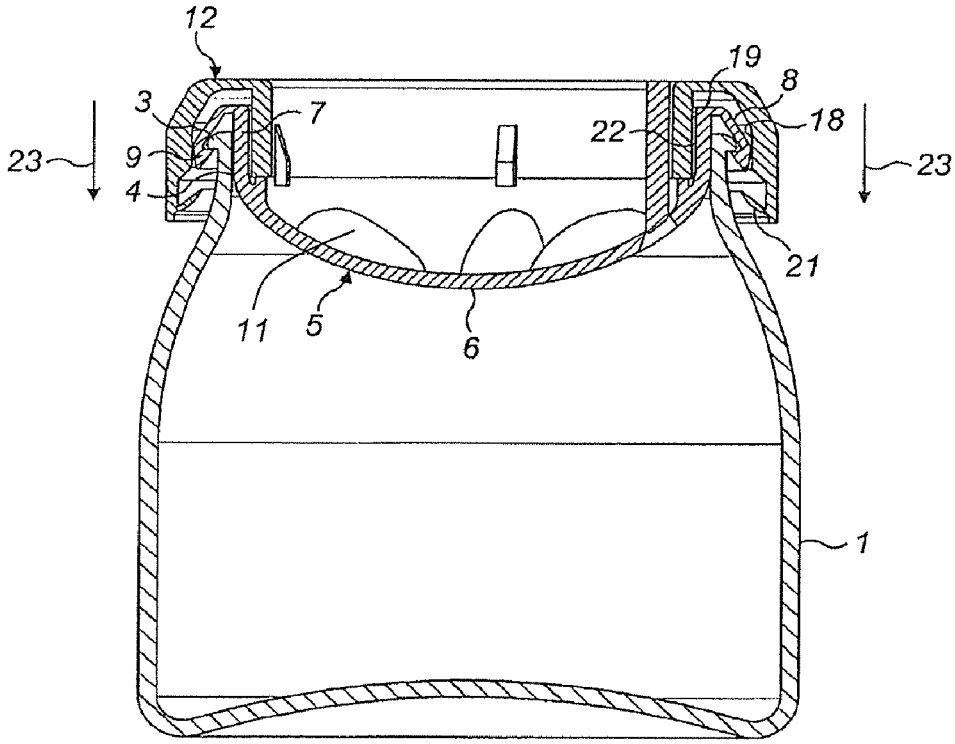

FIG. 5 also shows that the retaining ring has an outer inward facing surface 18, an inner outward facing surface 19 and a circumferential notch 20 formed in the outer inward facing surface 18, to provide an inwardly protruding rim 21, most clearly seen in FIG. 9.

In use, the drinking vessel 1, as illustrated in FIG. 5, is filled with a carbonated beverage (not shown) such as beer or a carbonated soft drink.

The lid for the container, comprising the cap 5 and retaining ring 12, is preassembled, as shown in cross-section in FIG. 5, with the retaining ring 12 being maintained in position on the cap 5 by the inner outward facing surface 19 of the retaining ring engaging with an inner surface 22 of the peripheral wall portion of the cap 5 and by the plurality of fingers 8 engaging in the notch 20.

The lid, comprising the preassembled cap and retaining ring, is pushed in the direction of arrow 23 onto the neck 2 of the drinking vessel 1.

Figure 6:
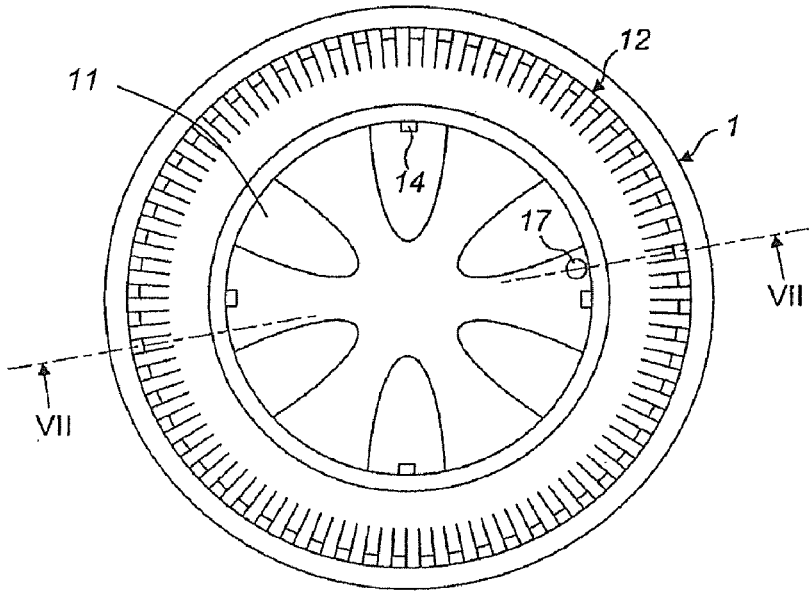
FIGS. 6 and 7 correspond to those of FIGS. 4 and 5, but showing the cap of the lid inserted into the drinking vessel.
Figure 7:
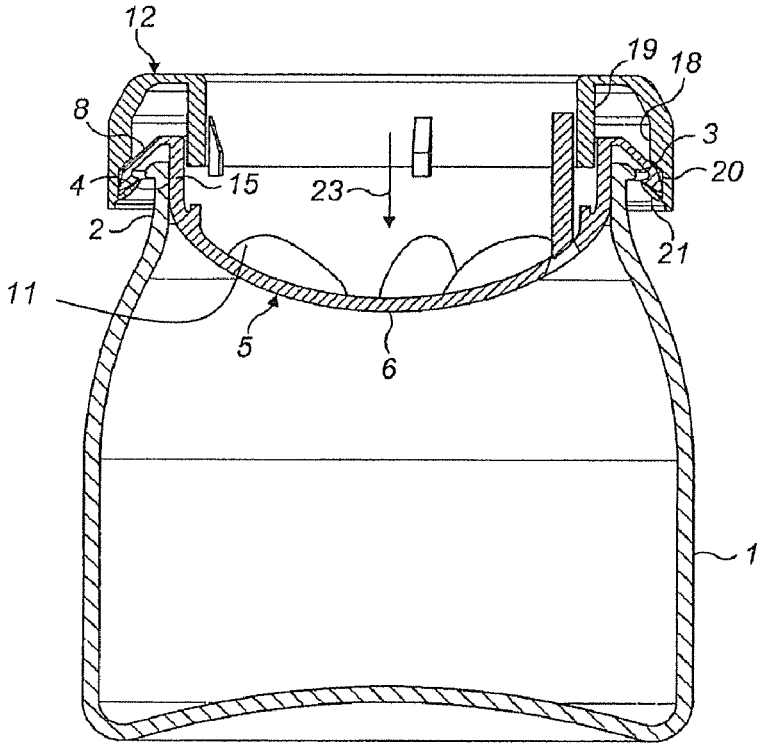

Referring to FIGS. 6 and 7, it is seen that the plurality of fingers 8 are retained in an open position by the notch 20, as they pass by the lip 3 of the vessel 1, with the first and second sealing surfaces 4 and 15 sealing the container.

Figure 8:
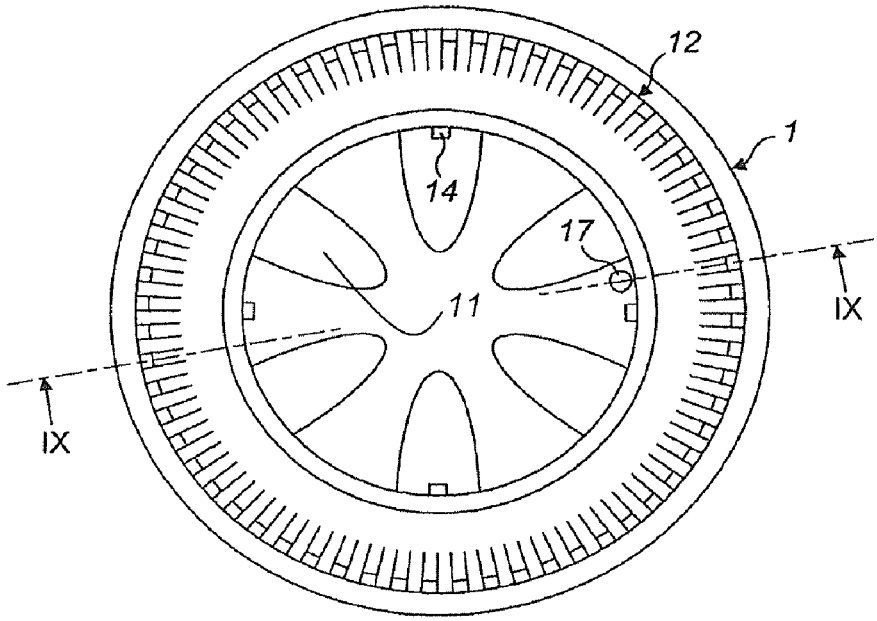
FIGS. 8 and 9 correspond to those of FIGS. 4 and 5, but showing the retaining ring in a locked position.

As shown in FIGS. 8 and 9, continued movement in the direction of arrows 23 causes the retaining ring 12 to be pushed further onto the cap 5 whereby the outer inward facing surface 18 of retaining ring 12 pushes the fingers 8 inwardly such that the protrusions 9 engage under the lip 3. In the position illustrated in FIGS. 8 and 9, the cap 5 is securely mounted and sealed with the drinking vessel 1, with the retaining ring 12 sandwiching the peripheral wall portion 7 and plurality of fingers 8 between the outer inward facing surface 18 and inner outward facing surface 19, such that the protrusions 9 retain the cap in place.

As $CO_2$ is released from the beverage, the pressure within the container increases exerting a force on the convex face 6. This acts to distort the face 6 and causes it to exert radially outward pressure onto the peripheral wall portion 7, increasing the sealing between the first and second sealing surfaces 4 and 15, respectively.

Figure 10:
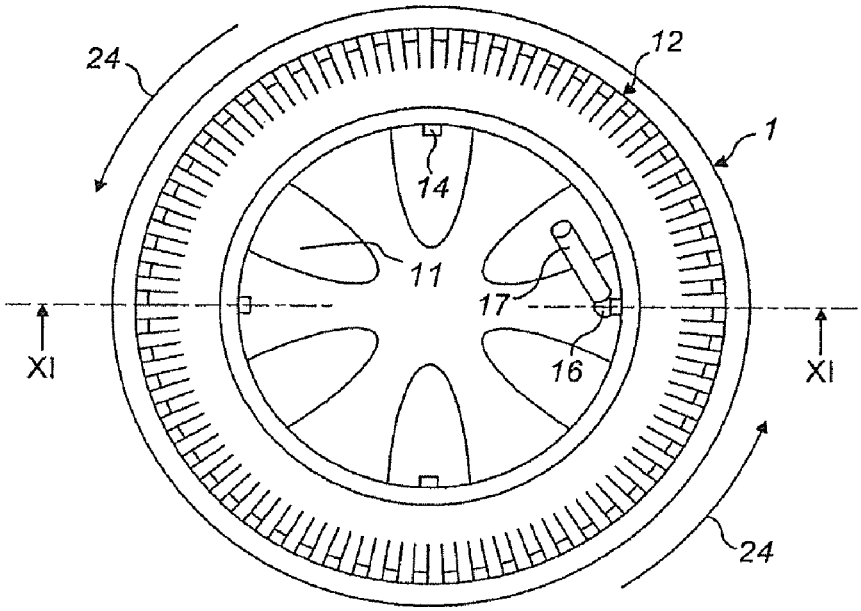
FIGS. 10 and 11 correspond to FIGS. 4 and 5, but showing the container at commencement of removal of the lid.
Figure 11:
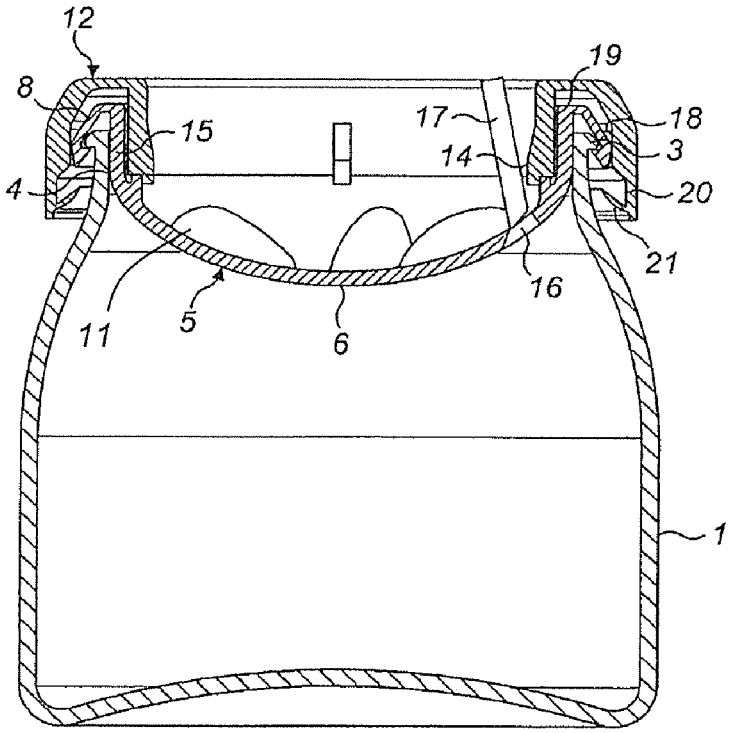

Referring now to FIGS. 10 and 11, there is illustrated the container at the commencement of release of the lid from the drinking vessel. The retaining ring 12 is rotated in the direction of arrows 24, which causes one of the protrusions 14 of the retaining ring to come into contact with and then to snap off the frangible pin 17, thus opening the hole 16 and releasing pressure within the container. The release of pressure within the container releases the contact pressure between protrusions 9 on the plurality of fingers 8 and the lower face of the lip 3 with which they are in contact.

Figure 12:
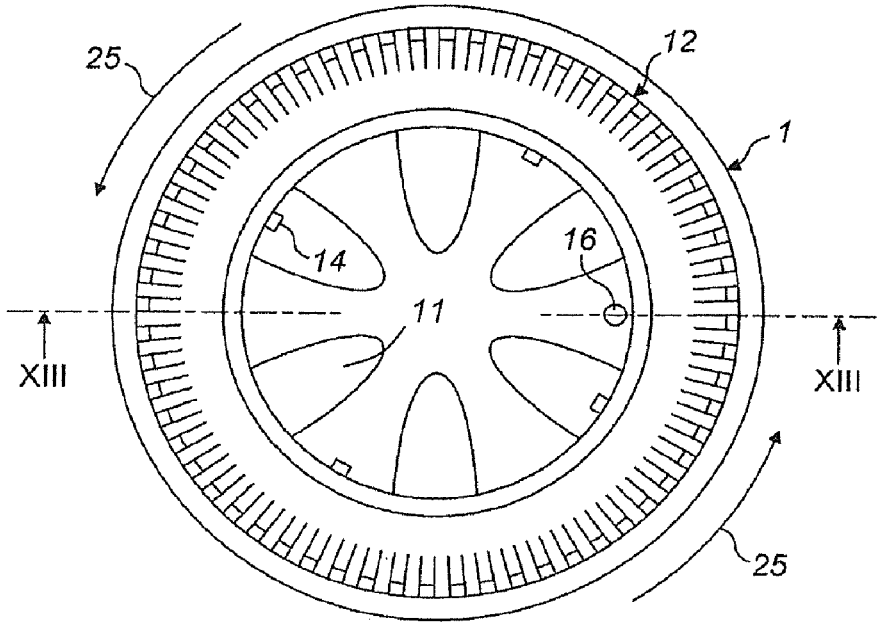
FIGS. 12 and 13 are correspond to FIGS. 4 and 5, but showing the lid in a released position.
Figure 13:
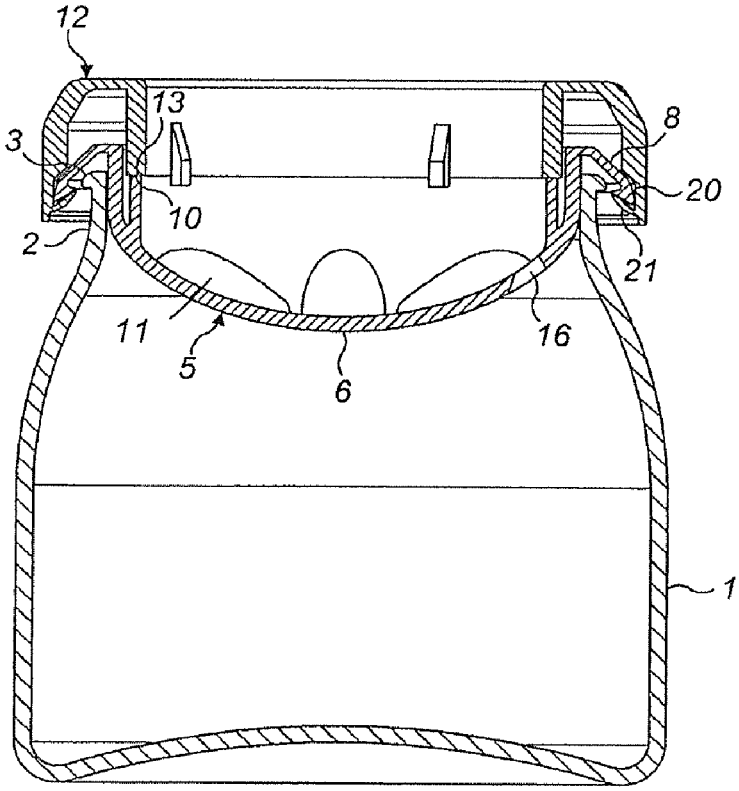
Figure 14:
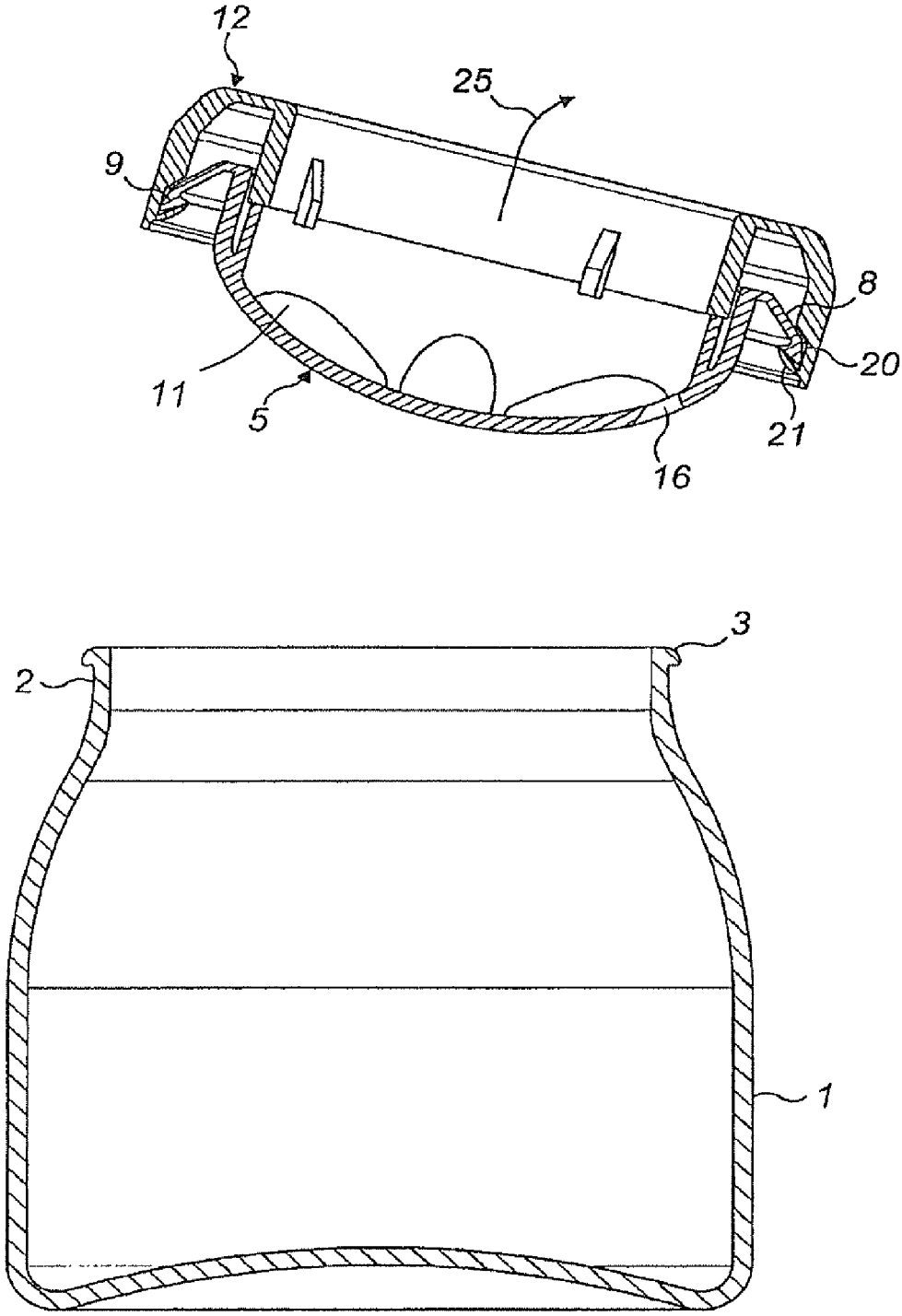
FIG. 14 is a corresponding cross-section to FIG. 13, but showing the container with the lid removed.

As shown in FIGS. 12 and 13, continued rotation of the retaining ring 12, in the direction of arrows 25, results in the cap cammed surfaces 10 interacting with the retaining ring cammed surfaces 13 to axially move apart the retaining ring 12 relative to the cap 5. This action causes the rim 21 to engage under the plurality of fingers 8 such that the plurality of fingers are received in the notch 20, lifting the protrusions 9 out from below the lip 3, whereby the lid is released from the drinking vessel and may be removed in the direction of arrow 25 as shown in FIG. 14.

The invention as hereinbefore described, by way of example only, with reference to the illustrated embodiment. However, it will apparent that any number of alternative embodiments are possible within the scope of the appended claims.

The invention claimed is:

1. A storage and drinking container assembly for pressurised beverages, the container assembly comprising:
- a drinking vessel comprising:
  - a circumferential sidewall; and
  - an open neck having a circumferential inner surface and lip; and,
- a lid for sealing the vessel, the lid comprising:
  - a cap comprising:
    - a concave closed top including a vent sealed by a pressure release closure in the form of a frangible peg,
    - an outer skirt having a plurality of fingers for engaging the lip, and
    - an inner circumferential wall extending upward from the concave closed top; and,
  - a retaining ring comprising:
    - an outer skirt to retain the fingers of the cap in contact with the lip, and
    - an inner skirt,
  - wherein at least one of the inner circumferential wall and the inner skirt includes at least cammed surface for cooperating with the other of the inner circumferential wall and the inner skirt so that rotation of the cap with respect to the retaining ring causes the at least one cammed surface to axially move the retaining ring apart from the cap.

2. The container assembly as claimed in claim 1, wherein the pressure release closure of the cap releases pressure from the vessel at the commencement of rotation of the retaining ring relative to the cap.

3. The container assembly as claimed in claim 1, wherein the inner circumferential wall of the cap extends upward at a circumference of the concave closed top and can be inserted into the neck of the vessel until the fingers extending from the outer skirt of the cap contact the lip, so that an inner outward facing surface of the retaining ring abuts an inward facing surface of the outer skirt of the cap and an outer inward facing surface of the retaining ring abuts an outward facing surface of the fingers to sandwich the fingers of the outer skirt of the cap between the outer inward facing surface and the inner outward facing surface of the retaining ring, with the neck and the lip of the vessel sandwiched between the fingers of the outer skirt of the cap.

4. The container assembly as claimed in claim 1, wherein the closed top is arranged such that any pressure within the vessel deforms the closed top to cause the inner surface circumferential wall to exert radial pressure on the inner surface of the open neck.

5. The container assembly as claimed in claim 1, wherein the cap and retaining ring are arranged to be fitted to the vessel by pushing the retaining ring and cap onto the vessel wherein the closed top of the cap is first forced to enter the neck of the vessel until the fingers engage the top of the neck of the vessel wherein the retaining ring and cap are then pushed axially together causing the retaining ring to retain the fingers under the lip of the neck of the vessel.

6. The container assembly as claimed in claim 1, wherein the cap and retaining ring are assembled prior to fitting to the container.

7. The container assembly as claimed in claim 1, arranged such that rotation of the retaining ring releases any pressure in the vessel and then releases the fingers so that the lid can then be removed from the vessel.

8. A storage and drinking container assembly for pressurized beverages, the container assembly comprising:

a drinking vessel comprising:

a circumferential sidewall;

an open neck having a circumferential inner surface and a lip; and, a lid for sealing the vessel, the lid comprising:

a cap comprising:

a concave closed top, an outer skirt having a plurality of fingers for engaging the lip, and an inner circumferential wall extending upward from the concave closed top; and a retaining ring comprising:

an outer skirt to retain the fingers of the cap in contact with the lip, the outer skirt having an inwardly protruding rim, and an inner skirt, wherein the at least one of the inner circumferential wall and the inner skirt includes at least one cammed surface for cooperating with the other of the inner circumferential wall and the inner skirt so that rotation of the cap with respect to the retaining ring causes the at least one cammed surface to axially move the retaining ring apart from the cap, and when the outer skirt of the retaining ring is axially moved apart from the cap, the inwardly protruding rim of the outer skirt of the retaining ring engages the fingers to lift them from under the lip.

9. The container assembly as claimed in claim 8, wherein the retaining ring retains protrusions on the fingers under the lip.

10. The container assembly as claimed in claim 8, wherein the lip is continuous about the neck.

11. The container assembly as claimed in claim 8, wherein the lip is formed on the top edge of the neck.

12. The container assembly as claimed in claim 8, wherein the cap is moulded as a single piece.

13. The container assembly as claimed in claim 8, wherein the cap comprises a single moulded piece and a sealing band.

14. The container assembly as claimed in claim 8, wherein the cap, and retaining ring are adapted to be threadlessly joined to seal the vessel.

15. The container assembly as claimed in claim 8, wherein the inner circumferential wall of the cap extends upward at a circumference of the concave closed top and can be inserted into the neck of the vessel until the fingers extending from the outer skirt of the cap contact the lip, so that an inner outward facing surface of the retaining ring abuts an inward facing surface of the outer skirt of the cap and an outer inward facing surface of the retaining ring abuts an outward facing surface of the fingers to sandwich the fingers of the outer skirt of the cap between the outer inward facing surface and the inner outward facing surface of the retaining ring, with the neck and the lip of the vessel sandwiched between the fingers of the outer skirt of the cap.

16. The container assembly as claimed in claim 8, wherein the closed top is arranged such that any pressure within the vessel deforms the closed top to cause the inner circumferential wall to exert radial pressure on the inner surface of the open neck.

17. The container assembly as claimed in claim 8, wherein the cap and retaining ring are arranged to be fitted to the vessel by pushing the retaining ring and cap onto the vessel wherein the closed top of the cap is first forced to enter the neck of the vessel until the fingers engage the top of the neck of the vessel wherein the retaining ring and cap are then pushed axially together causing the retaining ring to retain the fingers under the lip of the neck of the vessel.

18. The container assembly as claimed in claim 8, wherein the cap and retaining ring are assembled prior to fitting to the container.

19. The container assembly as claimed in claim 8, arranged such that rotation of the retaining ring releases any pressure in the vessel and then releases the fingers so that the lid can then be removed from the vessel.

20. The container assembly as claimed in claim 8, wherein the lip is on an outer surface of the neck.

21. The container assembly as claimed in claim 20, wherein when the lid is on the vessel the fingers of the cap extend from the cap over the lip.

* * * * *

UNITED STATES PATENT AND TRADEMARK OFFICE

CERTIFICATE OF CORRECTION

PATENT NO. : 8,360,256 B2
APPLICATION NO. : 12/226402
DATED : January 29, 2013
INVENTOR(S) : Michael O'Brien It is certified that error appears in the above-identified patent and that said Letters Patent is hereby corrected as shown below:

In the Claims

Column 6, Claim 1, line 53 — After "least"

Insert -- one --

Signed and Sealed this
Eighth Day of July, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,360,256 B2
APPLICATION NO. : 12/226402
DATED : January 29, 2013
INVENTOR(S) : Michael O'Brien It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 794 days.

Signed and Sealed this
First Day of September, 2015

Michelle K. Lee

Michelle K. Lee
*Director of the United States Patent and Trademark Office*